US008689992B2

(12) United States Patent
Anderson et al.

(10) Patent No.: US 8,689,992 B2
(45) Date of Patent: Apr. 8, 2014

(54) WOOD AND RESIN DECK BOX

(75) Inventors: Torrence Anderson, Overland Park, KS (US); William J. Phillips, Batavia, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 151 days.

(21) Appl. No.: 13/020,558

(22) Filed: Feb. 3, 2011

(65) Prior Publication Data

US 2012/0199600 A1 Aug. 9, 2012

(51) Int. Cl.
*B65D 6/00* (2006.01)

(52) U.S. Cl.
USPC ..... 220/4.01; 220/4.28; 220/4.31; 220/4.32; 220/810; 217/12 R; 217/13; 217/43 R

(58) Field of Classification Search
USPC ..... 220/4.01, 4.28, 4.31–4.33, 810; 217/12 R, 13, 17, 29–31, 43 R, 48, 51, 217/57
IPC ..... B65D 6/00,6/14, 6/28, 8/00, 8/14, 8/18
See application file for complete search history.

(56) References Cited

U.S. PATENT DOCUMENTS

| | | | | | |
|---|---|---|---|---|---|
| 300,512 | A | * | 6/1884 | Ringo et al. | 232/2 |
| 984,784 | A | * | 2/1911 | Tilton | 217/13 |
| 1,700,086 | A | | 1/1929 | Sherwood | |
| 2,347,192 | A | | 4/1944 | Grice | |
| 3,262,597 | A | * | 7/1966 | Coffey, Jr. | 217/12 R |
| 3,379,341 | A | | 4/1968 | Miles | |
| RE28,846 | E | * | 6/1976 | Wait | 217/16 |
| 3,966,084 | A | | 6/1976 | Box | |
| 3,977,712 | A | | 8/1976 | Northrop | |
| 3,987,829 | A | | 10/1976 | Leone | |
| 4,050,604 | A | * | 9/1977 | Flanders | 220/4.28 |
| 4,466,541 | A | | 8/1984 | Tabler et al. | |
| 4,484,688 | A | * | 11/1984 | Smith | 217/91 |
| 4,486,917 | A | | 12/1984 | Johnston et al. | |
| 4,523,692 | A | | 6/1985 | Lemkin | |
| 4,650,084 | A | * | 3/1987 | Long | 217/12 R |
| 4,662,515 | A | | 5/1987 | Newby, Sr. | |
| 4,782,972 | A | | 11/1988 | Wenkman et al. | |
| 4,789,078 | A | | 12/1988 | Miller et al. | |
| 4,809,851 | A | | 3/1989 | Oestreich, Jr. | |
| 4,863,062 | A | | 9/1989 | Holliday | |
| 4,896,518 | A | | 1/1990 | Appelgren | |
| 4,899,420 | A | | 2/1990 | Bye et al. | |
| 4,917,256 | A | | 4/1990 | Kruck et al. | |
| D308,486 | S | | 6/1990 | Willson | |
| D308,487 | S | | 6/1990 | Willson | |
| D309,106 | S | | 7/1990 | Willson | |

(Continued)

*Primary Examiner* — Mickey Yu
*Assistant Examiner* — Brijesh V. Patel
(74) *Attorney, Agent, or Firm* — McHale & Slavin, P.A.

(57) ABSTRACT

The present invention relates to a storage box or container which is formed from a combination of wood and resin or plastic components. The front, back, and sides of the storage box are preferably set into a channel on a base of the container. A circumferential member is secured to the top portions of the front, back, and sides of the storage box to retain these members in alignment. A top member is hingedly secured to the circumferential member, which enables ready access into the storage box. The storage box is formed from components which are capable of being packaged and shipped in a knocked-down state and constructed into a storage box on site, thereby saving shipping space and costs.

13 Claims, 13 Drawing Sheets

(56) References Cited

U.S. PATENT DOCUMENTS

| | | | | | |
|---|---|---|---|---|---|
| 5,109,986 | A | * | 5/1992 | Pruitt, Jr. | 206/600 |
| 5,133,472 | A | | 7/1992 | Koda et al. | |
| D329,331 | S | | 9/1992 | Hobson | |
| D329,747 | S | | 9/1992 | Embree | |
| 5,161,709 | A | | 11/1992 | Oestreich, Jr. | |
| 5,163,204 | A | | 11/1992 | Jackson | |
| 5,193,706 | A | | 3/1993 | Hanna et al. | |
| D334,662 | S | | 4/1993 | van Berne | |
| D342,609 | S | | 12/1993 | Brightbill | |
| 5,360,128 | A | * | 11/1994 | Hessenthaler | 217/13 |
| 5,368,380 | A | | 11/1994 | Mottmiller et al. | |
| 5,386,919 | A | * | 2/1995 | Long | 217/36 |
| 5,464,115 | A | | 11/1995 | Tisbo et al. | |
| 5,560,508 | A | * | 10/1996 | Hsu | 220/4.31 |
| 5,669,507 | A | * | 9/1997 | Pruitt, Jr. | 206/600 |
| 5,704,508 | A | | 1/1998 | Keip et al. | |
| 5,743,421 | A | * | 4/1998 | Gonzalez et al. | 220/4.28 |
| 5,816,425 | A | | 10/1998 | Keip et al. | |
| 5,823,374 | A | * | 10/1998 | Wu | 217/51 |
| 5,979,352 | A | | 11/1999 | Pearcy et al. | |
| D421,181 | S | | 2/2000 | Tisbo et al. | |
| 6,036,041 | A | * | 3/2000 | Chern | 220/6 |
| 6,050,291 | A | | 4/2000 | Whitehead et al. | |
| D444,626 | S | | 7/2001 | Anderson et al. | |
| 6,419,103 | B1 | * | 7/2002 | Wang | 220/4.33 |
| 6,497,018 | B1 | * | 12/2002 | Chiu et al. | 27/2 |
| D483,190 | S | | 12/2003 | Richardson | |
| 7,028,859 | B2 | | 4/2006 | Moon et al. | |
| 7,240,609 | B2 | * | 7/2007 | Berecz | 99/277.1 |
| 7,823,738 | B2 | * | 11/2010 | Wang | 220/4.28 |
| 2004/0124191 | A1 | * | 7/2004 | Colladon | 220/4.01 |
| 2004/0200832 | A1 | * | 10/2004 | Moon et al. | 220/4.28 |
| 2007/0138172 | A1 | * | 6/2007 | Richardson et al. | 220/4.01 |
| 2008/0168931 | A1 | * | 7/2008 | Wang | 108/157.1 |
| 2008/0290098 | A1 | * | 11/2008 | Wang | 220/660 |
| 2009/0032530 | A1 | * | 2/2009 | Chu | 220/4.28 |
| 2009/0184115 | A1 | * | 7/2009 | Wang | 220/4.26 |
| 2012/0110926 | A1 | * | 5/2012 | Phillips et al. | 52/79.9 |

* cited by examiner

WOOD AND RESIN DECK BOX

RELATED APPLICATIONS

This application is related to U.S. Pat. No. 5,464,115, issued Nov. 7, 1995, entitled "MOLDED PLASTIC FOOT-LOCKER", and U.S. Pat. No. 7,028,859, issued Apr. 18, 2006, entitled "DECK STORAGE BOX", the entirety of the patents are incorporated herein by reference.

FIELD OF THE INVENTION

The present invention relates generally to a storage box or container constructed of wood and resin materials for use on a deck. More specifically, the present invention relates to a deck storage box utilizing injection molded resin panels and wood panels combined to form the storage box. The storage box is capable of being packaged and shipped in a knocked-down state and constructed into a secure deck storage box.

BACKGROUND OF THE INVENTION

Devices for storing items such as gardening tools, children's toys, barbeque accessories and the like out of doors is well known. Permanent structures, such as utility sheds or garages, are often utilized for storage of these items. Recently, patios and decks have become a common addition to homes. These structures provide space for families to enjoy outdoor activities and recreation. However, these structures occupy a great deal of yard or lawn space available to a homeowner. This lawn space is not available to the homeowner for utility sheds or other permanent storage structures. This lack of space for additional structures requires the homeowner to find additional storage space for items normally stored in utility sheds.

Devices for storing items related to activities on or near the water are also well known. Permanent structures such as boat houses are often employed for storage of boats and other related equipment. It can be appreciated that on beaches and other waterfront properties, there are often many types of water vehicles and recreational equipment. Additionally, equipment such as life jackets, fishing gear, floats and other items which may be utilized on and in the water require storage adjacent the water. If there is no storage adjacent the waterside, the equipment must be carried back and forth between storage spaces remote from the waterside and the waterside. Alternatively, items can be placed on a boat for storage. However, this does not provide adequate security for these items.

Although permanent structures such as boathouses or utility sheds may provide adequate storage, such structures have several drawbacks. The permanent structures may be very costly to construct and maintain. In addition to the cost, the permanent structures may require a building permit or occupancy permit.

In addition to permanent storage sheds or boathouses, the prior art had proposed a number of different panel systems or kits comprising blow molded or extruded panels and connector members which form a wide variety of structures. Typically, these systems require extruded metal or plastic connector members having a specific cross-sectional geometry that facilitates an engagement between such members and one or more plastic panels having a complimentary edge configuration.

A particularly common structure for the connector members is the I-beam cross section. The I-beam defines free edge portions of the connector member which fit within appropriately dimensioned and located slots in the panel members. U.S. Pat. No. 5,979,352 discloses a storage box that is representative of the state of the art I-beam connector members. The I-beam sides of the connectors engage with the peripheral edge channels of a respective wall panel, and thereby serve to join such panels together at right angles. Straight or in-line versions of the connector members are also included in the kits to join panels in a coplanar relationship to create walls of varying length.

DESCRIPTION OF THE PRIOR ART

The prior art has also suggested a number of smaller one piece plastic containers with removable lids for storage. U.S. Pat. Nos. D308,486, D308,487, and D309,106 are examples of these containers. Typically, these containers provide portability of storage but lack the capacity to store larger items. Furthermore, since these storage devices do not break down they are difficult to ship from the manufacturer to the consumer.

Such prior art systems, while working well, have not met all of the needs of manufacturers to provide a product that can be easily manufactured, packaged and shipped, or the needs of consumers requiring structural integrity combined with modularity and aesthetic appearance.

Paramount among such needs is a panel system which creates deck storage box walls which resist panel separation, buckling, racking, and weather infiltration. Security is a further consideration; the box formed by the panels must tie into the cover and bottom in such a way as to unify the entire enclosure. Also, from a versatility standpoint, a cover should be present which can be easily interchanged after assembly of the sides and bottom components, and which provides additional seating as well as dependable security and pivoting access to the contents of the deck box.

There are also commercial considerations that must be satisfied by any viable deck box system or kit; considerations which are not entirely satisfied by the current state of the art containers. The deck storage box must be formed of relatively few component pieces which are inexpensive to manufacture by conventional techniques. The deck storage box must also be capable of being packaged and shipped in a knock-down state. In addition, the system must be modular and facilitate the creation of a family of enclosures that vary in appearance and functionality but which share common, interchangeable components.

Finally, there are ergonomic needs that an enclosure system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from internal storage volume of the resulting deck storage box or otherwise negatively affect the utility of the deck storage box.

SUMMARY OF THE INVENTION

The present invention relates to a storage box or container which is formed from a combination of wood and resin or plastic components. The front, back, and sides of the storage box are preferably set into a channel on a base of the container. A circumferential member is secured to the top portions of the front, back, and sides of the storage box to retain these members in alignment. A top member is hingedly secured to the circumferential member, which enables ready access into the storage box. The storage box is formed from components which are capable of being packaged and shipped in a knocked-down state and constructed into a storage box on site, thereby saving shipping space and costs.

Accordingly, it is an objective of the present invention to provide a modular deck storage box system or kit having components which are shipped in a knocked-down state and readily assembled into a deck storage box.

It is a further objective of the present invention to provide a modular deck storage box system or kit having components formed from wood and resin or plastic which presents an aesthetically pleasing appearance.

It is yet another objective of the present invention to provide a modular deck storage box system or kit which can be readily assembled using a minimum number of tools.

It is a still further objective of the present invention to provide a modular deck storage box which includes front, back, and side panels that are constructed of tongue and groove wood slats that are held together by horizontal supports, the corners of the storage box are also formed from wood with tongue and groove connections.

It is still yet a further objective of the present invention to provide a modular deck storage box including a resin or plastic lid and bottom portion which are naturally weather resistant and waterproof to keep the items within the storage box dry.

It is still yet a further objective of the present invention to provide a modular deck storage box including resin or plastic panels which include a geometry molded there into that captures and overlaps wood panels to create a water tight interface therebetween.

It is still yet a further objective of the present invention to provide gas springs to lift the lid of the storage box open and prevent it from falling closed.

It is still yet a further objective of the present invention to provide a lid for a modular deck storage box which will also function as a seat.

It is still yet a further objective of the present invention to provide a lid for a modular storage box which can be locked to secure the contents of the storage box.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
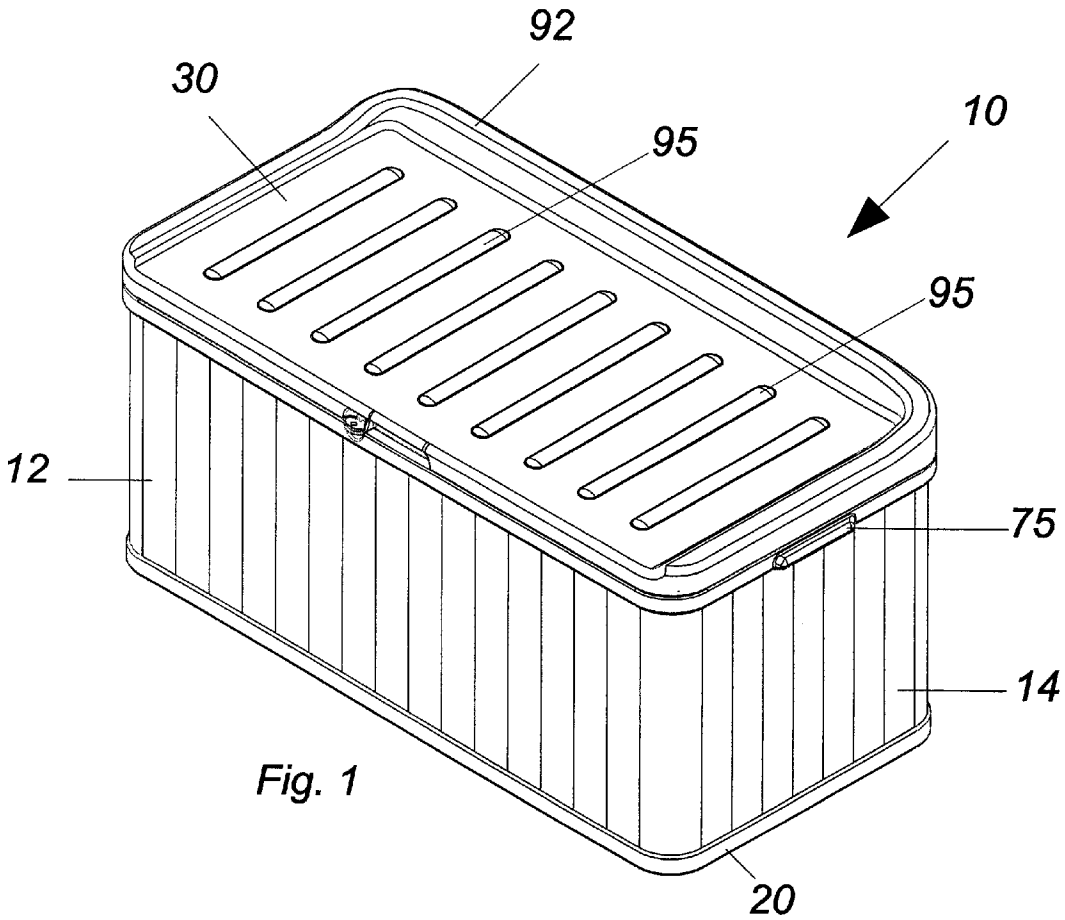
FIG. 1 is a front perspective view of the present invention.
Figure 2:
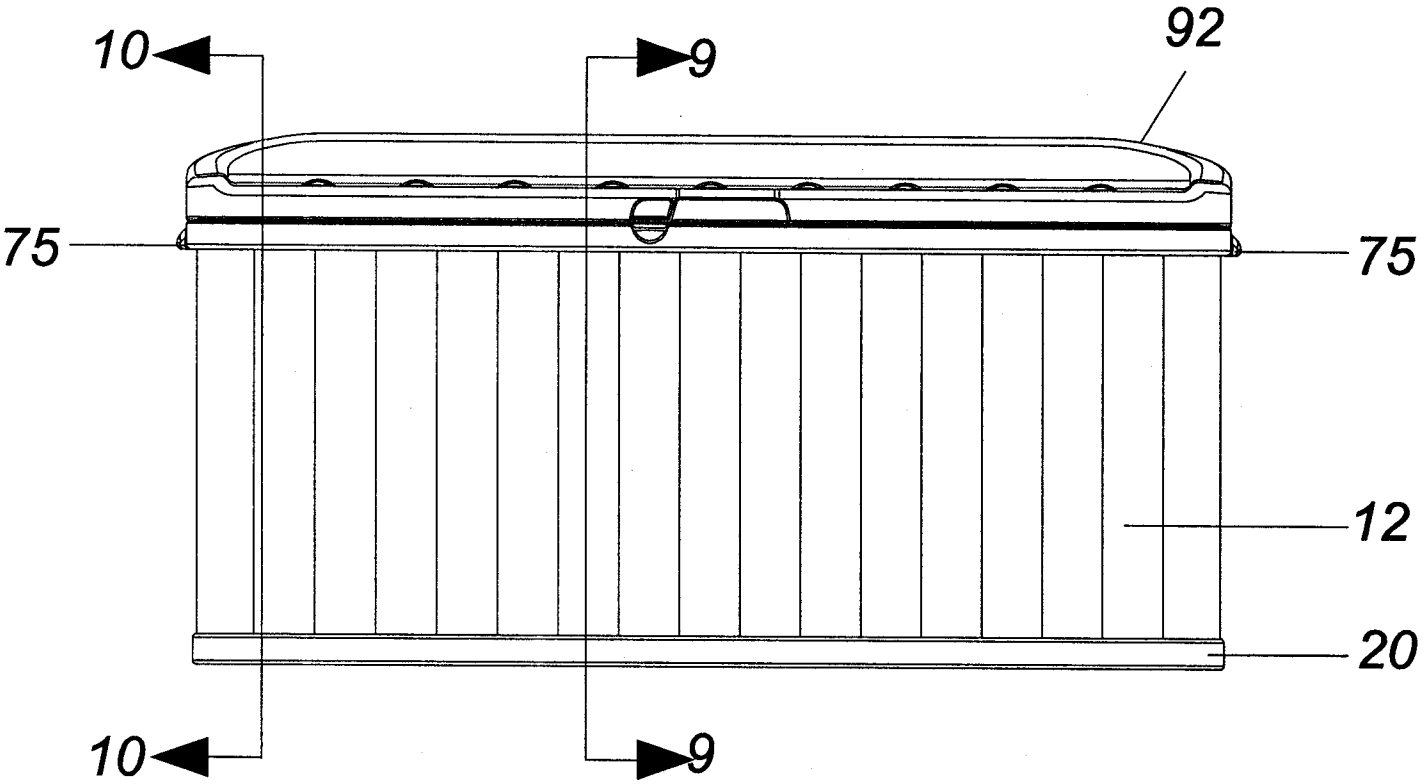
FIG. 2 is a front plan view of the present invention.
Figure 3:
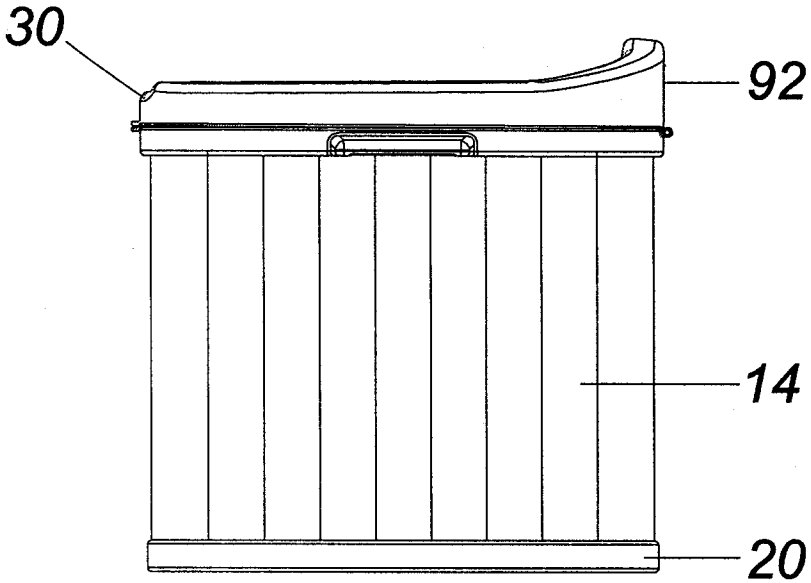
FIG. 3 is a side plan view of the present invention.
Figure 4:
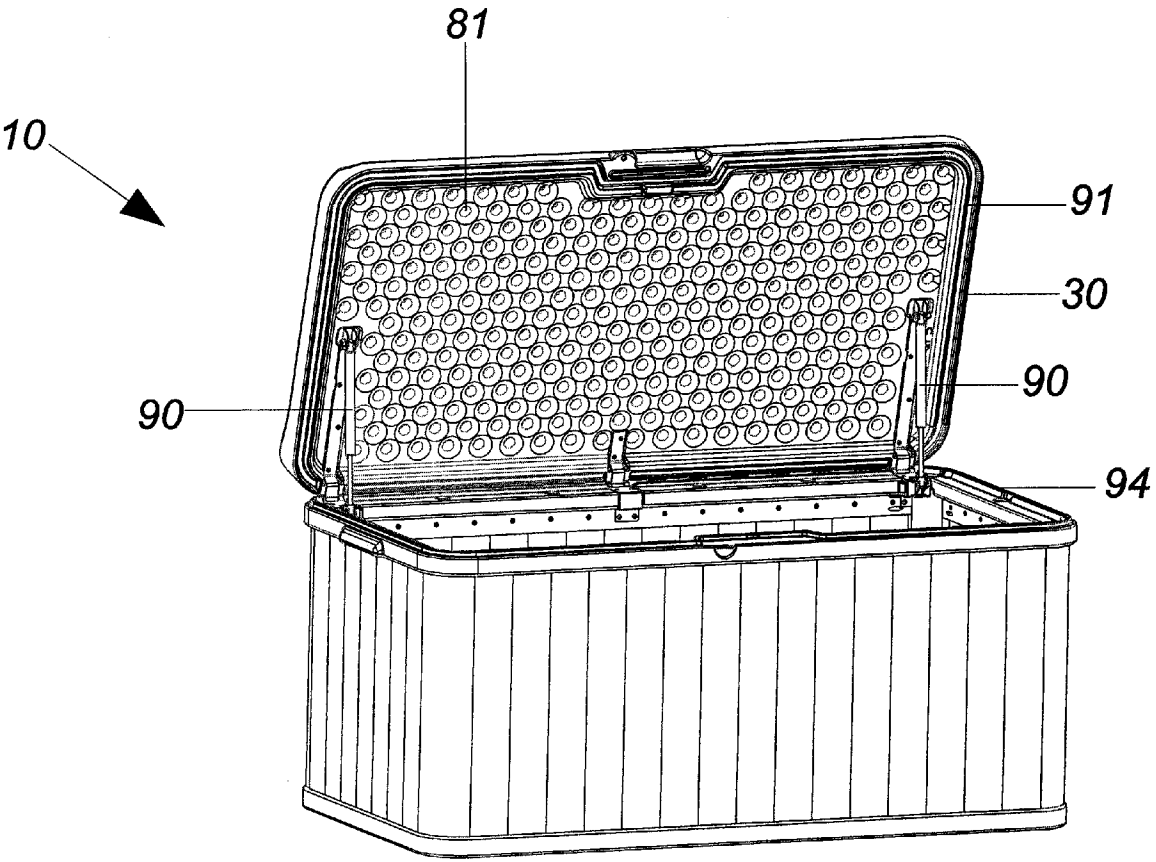
FIG. 4 is a front perspective view of the present invention with the lid open.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 5:
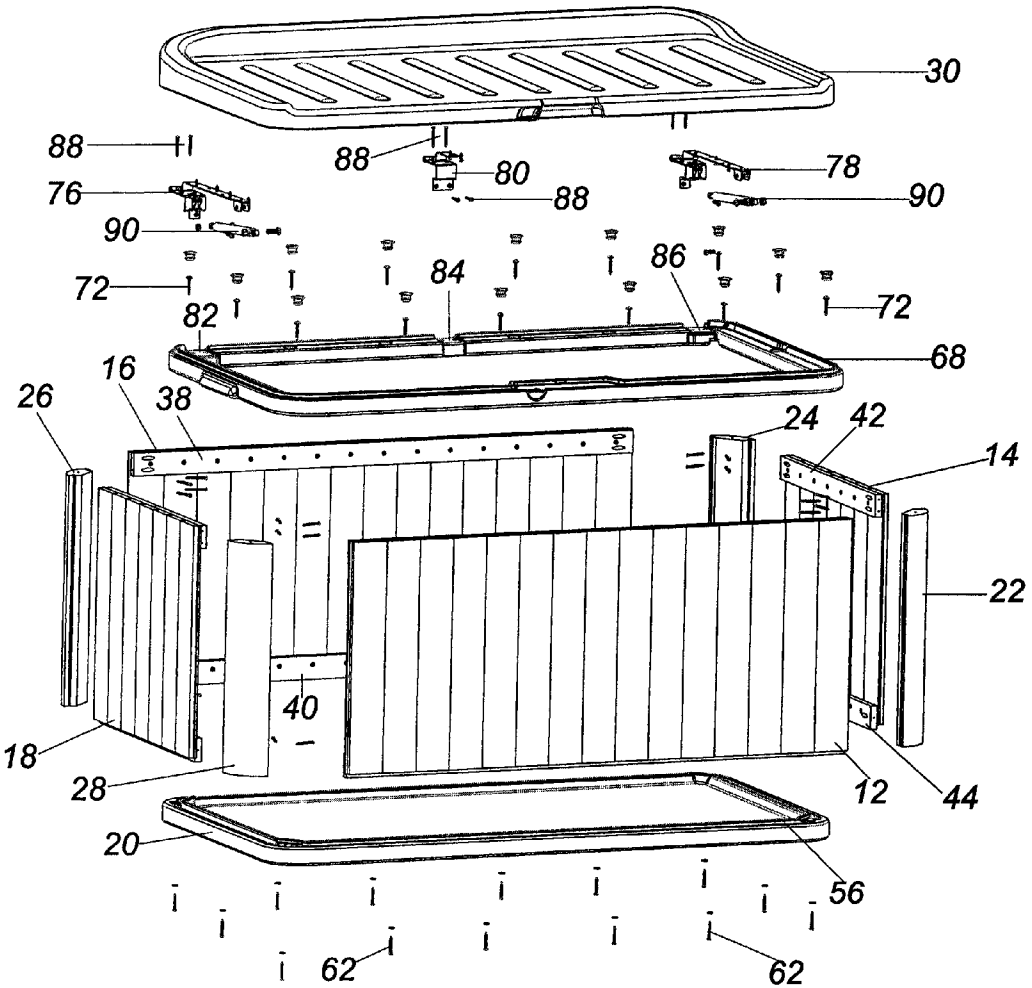
FIG. 5 is an exploded view of the present invention.

FIGS. 1-12, which are now referenced, illustrate plan, perspective and exploded views of a system or kit for the assembly of an embodiment of the present invention. A deck box which can be used for storage or as furniture is generally illustrated at 10. As seen in FIG. 5, the deck box includes a front panel 12, a right side panel 14, a back panel 16, a left side panel 18, a bottom or floor panel 20, corner posts 22, 24, 26, 28 and a lid 30. These panels and posts are secured to one another in a manner which will be described hereinafter to form the deck box of the present invention. The construction of the panels and lid, and the manner in which they fit together form the system or kit of the present invention. The system or kit is designed so that the present invention may be manufactured, shipped in a knocked down or disassembled state, and assembled with a minimum number of tools.

Figures 11A, 11B:
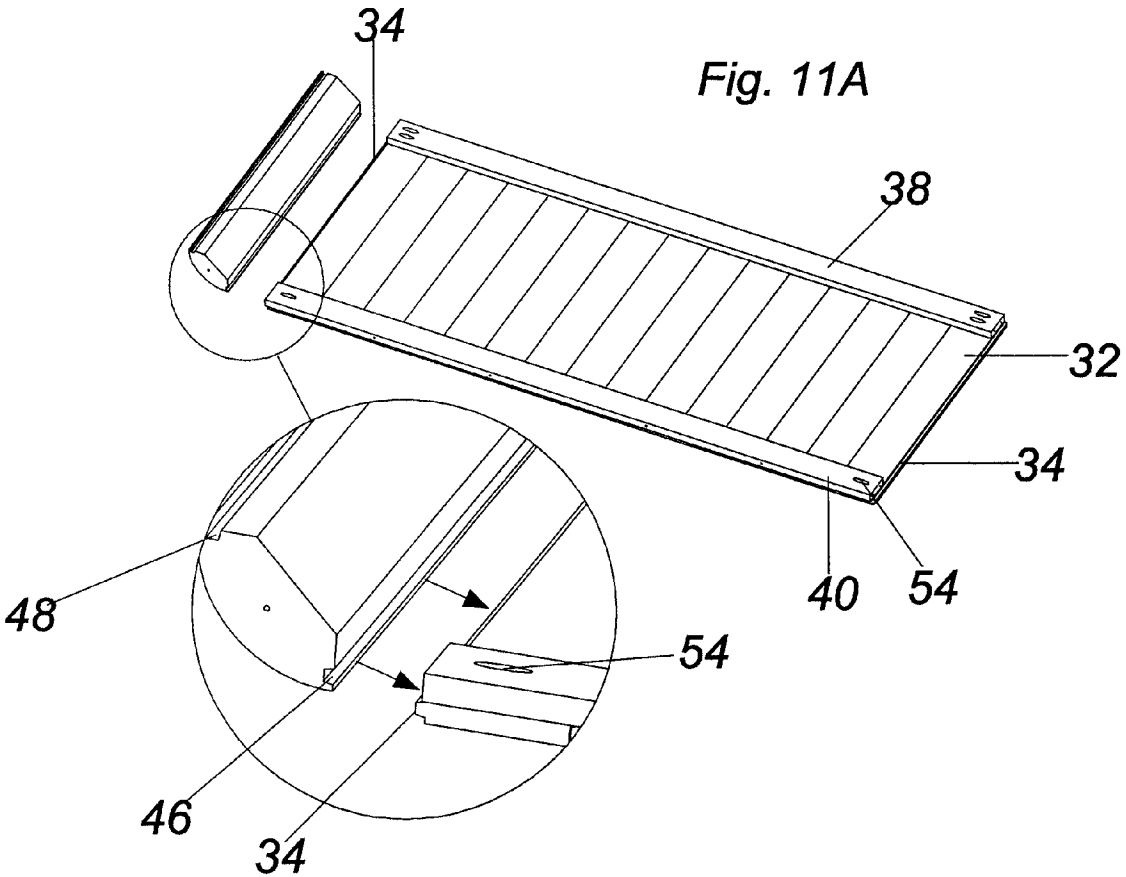
FIG. 11A is a perspective view of a front/back panel and a corner post.
FIG. 11B is a detailed view of the connection between the front/back panel and a corner post.
Figure 13:
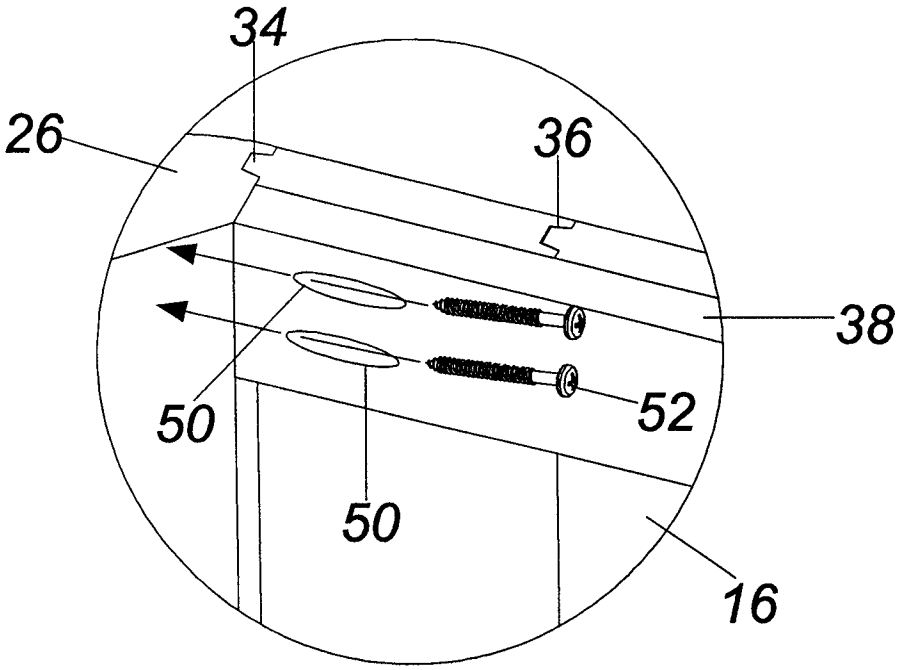
FIG. 13 is a detailed view of the tongue and groove connection between slats.

FIG. 11A illustrates the construction of either the front panel 12 or back panel 16. While these panels are preferably of the same construction, the construction of these panels can also vary. Each of the panels 12 and 16 include a plurality of slats or members 32. These slats or members are preferably made of wood, but other materials can also be employed in their construction. Each of the slats 32 includes a tongue 34 along one longitudinal edge and a complementary groove 36 along an opposite longitudinal edge (FIG. 13). The tongue 34 of one slat 32 is designed to fit into the groove 36 of an adjacent slat 32. This inter-fitting relationship assures a strong and tight fit between the slats. This relationship also prevents adjacent slats from warping with respect to each other.

Figure 9:
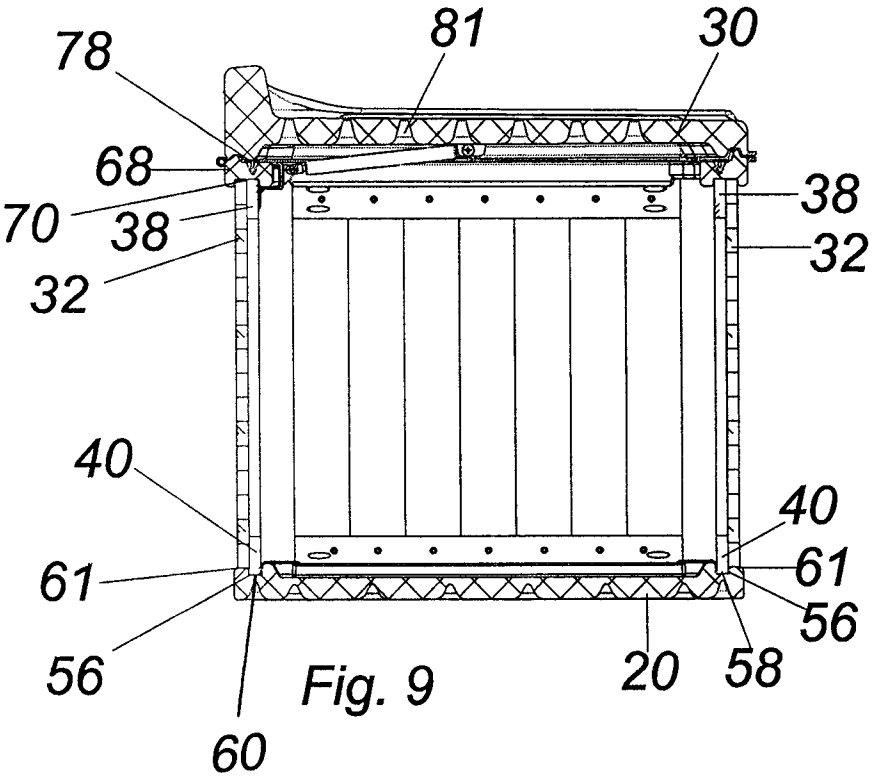
FIG. 9 is a cross sectional view of the present invention taken along line 9-9 in FIG. 2.
Figure 10:
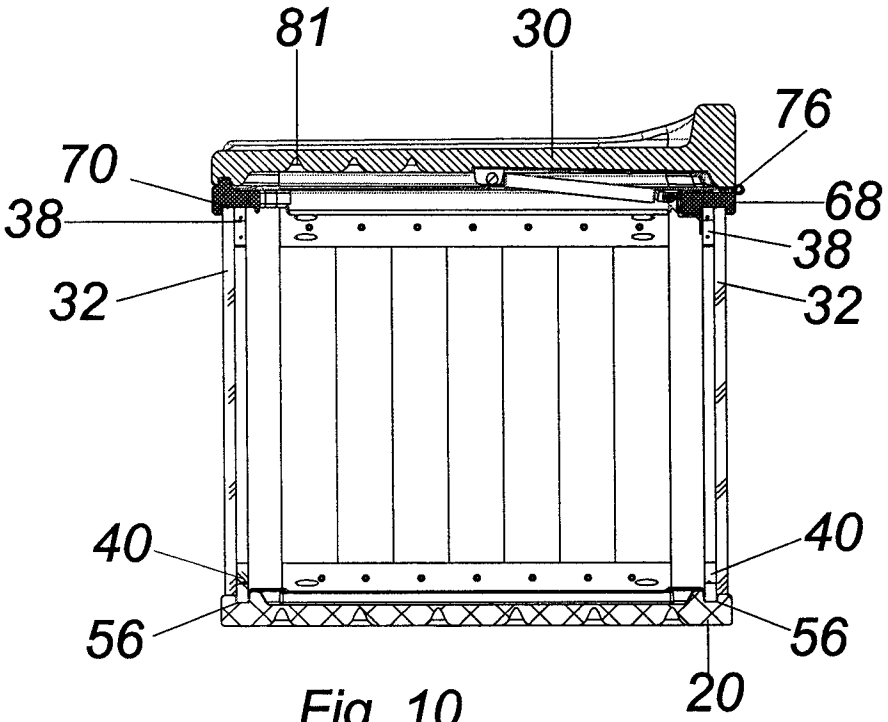
FIG. 10 is a cross sectional view of the present invention taken along line 10-10 in FIG. 2.
Figure 12:
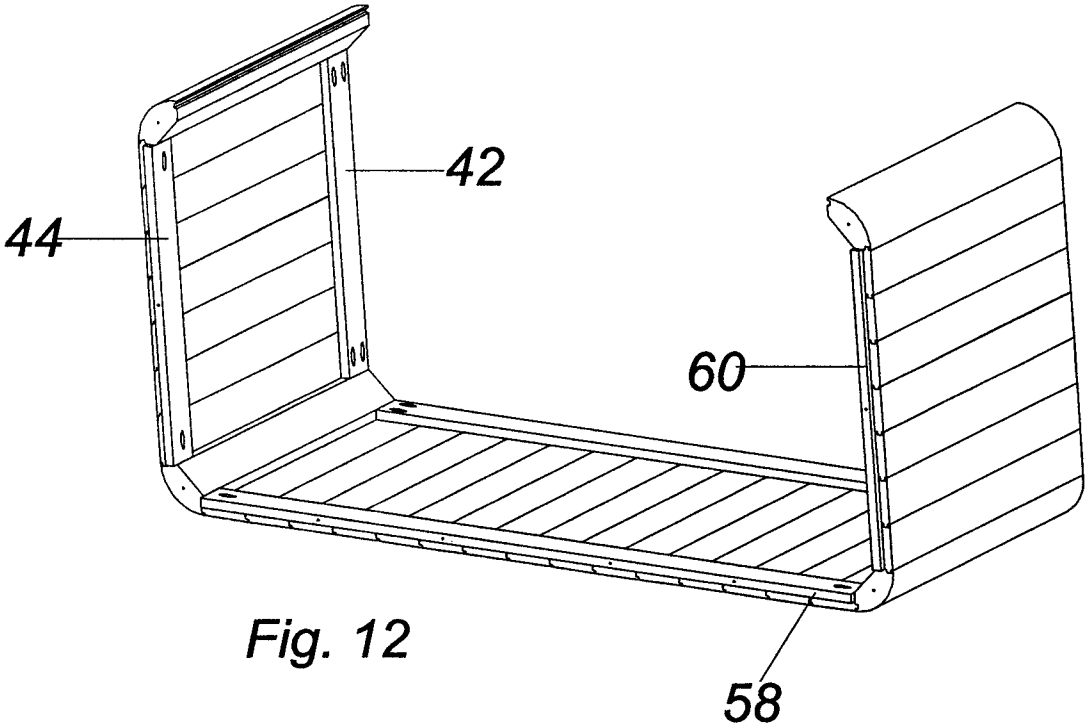
FIG. 12 is a perspective view of a front/back panel, a right side panel and left side panel.

An upper cross brace 38 extends along the top portion of the slats 32 of the front and back panels (FIGS. 5 and 11A). The top edge of upper cross brace 38 is even or flush with the top edges of the slats 32 of the front and back panels, as illustrated in FIGS. 9 and 10. A lower cross brace 40 extends along the bottom portion of the slats 32 of the front and back panels (FIGS. 5 and 11A). The bottom longitudinal edge of lower cross brace 40 extends slightly below the bottom edges of slats 32, as illustrated in FIGS. 9 and 10. The purpose of this will be explained hereinafter. Cross braces 38 and 40 are secured to slats 32 by adhesives and/or fasteners. The cross braces 38 and 40 are secured to the slats 32 at the factory in order to assure the correct relationship between the slats and the cross braces. The left and right side panels 14 and 18 are formed in a manner similar to the front and back panels. An upper cross brace 42 is secured along the top portions of slats 32 of the side panels (FIGS. 5 and 12). The top edge of the upper cross brace 42 is even or flush with the top edges of the slats 32 of the side panels, as illustrated in FIG. 5. A lower cross brace 44 extends along the bottom portion of the slats 32 of the side panels. The bottom longitudinal edge of the lower cross brace 44 extends slightly below the bottom edges of the slats 32, as illustrated in FIGS. 5 and 12. The purpose of this will be explained hereinafter. Cross braces 42 and 44 are secured to slats 32 by adhesive and/or fasteners. The cross braces 42 and 44 are secured to the slats 32 at the factory in order to assure the correct relationship between the slats and the cross braces. Cross braces 38, 40, 42 and 44 are preferably formed from wood.

Corner posts 22-28 are employed to secure the front, back and side panels to each other. Each of the corner posts 22-28 includes a groove 46 along one longitudinal edge and a groove 48 along an opposite longitudinal edge. Grooves 46 and 48 (FIG. 11B) are designed to fit together with a tongue 34 of a slat 32 of the front, back and side panels. Each of the slats 32 which form an end of the front, back, and side panels, includes a tongue 34 along its outer edge (FIGS. 11A and B). These tongues 34 are designed to fit into and cooperate with grooves 46 and 48 of the corner posts to secure the front, back and side panels to the corner posts, as illustrated in FIG. 13. Each of the cross braces 38, 42 at the top of the front, back and side panels include two slots 50 at each end into which a fastener or screw 52 is inserted (FIG. 13). The fastener 52 engages the corner post 26 and draws the corner post into tight engagement with one of the front, back or side panels. Each of the cross braces 40, 44 at the bottom of the front, back and side panels includes one slot 54 at each end into which a fastener or screw 52 is inserted (FIGS. 11A and B). The fastener 52 engages the corner posts and draws the corner posts into tight engagement with one of the front, back, or side panels. Corner posts are preferably formed from wood.

Figure 6:
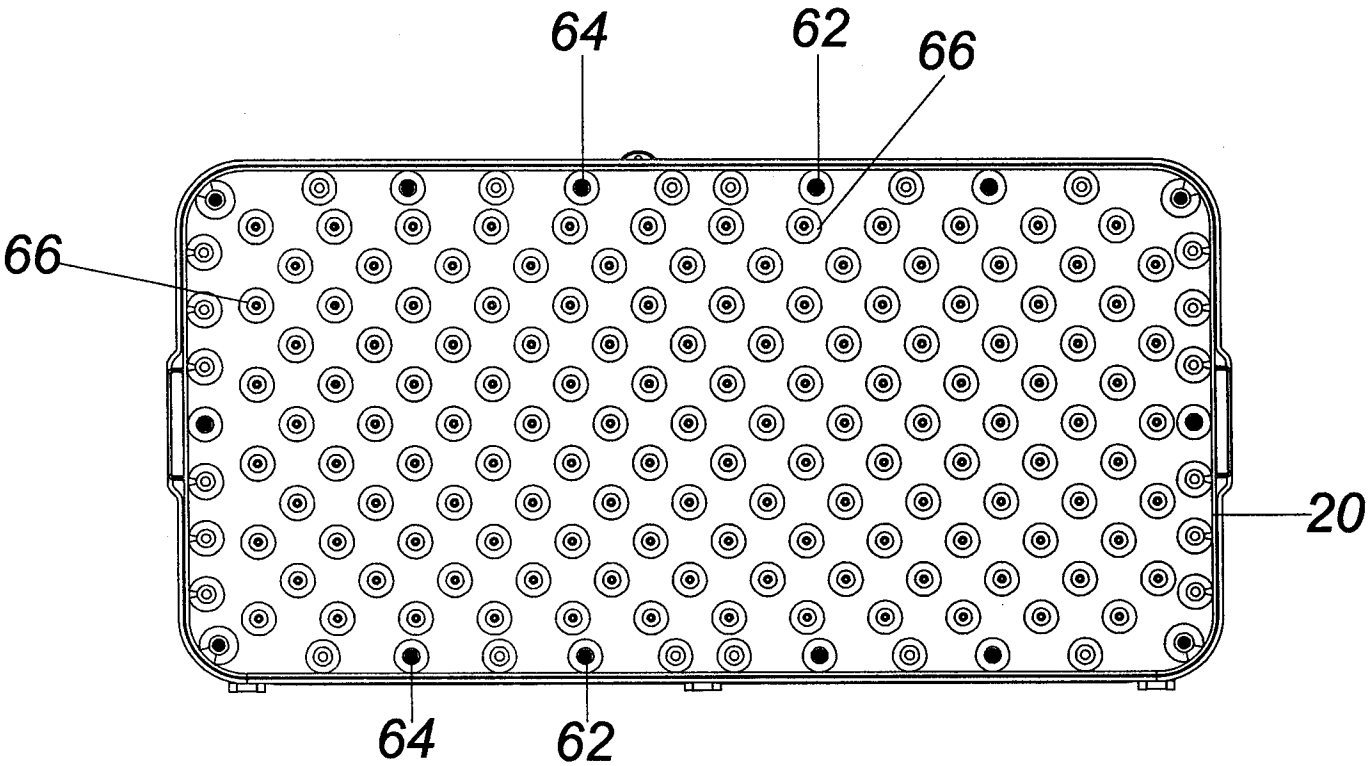
FIG. 6 is a view of the underside of the bottom panel of the present invention.

After the front, back and side panels are secured to each other, the floor or bottom panel 20 is secured to these panels. Bottom panel 20 includes a groove 56 which extends around an upper periphery thereof, as illustrated in FIGS. 5, 9, and 10. The bottom longitudinal edges 58 and 60 of cross braces 40 and 44 (FIGS. 9 and 12) respectively fit into groove 56. The bottom edges of slats 32 of the front, back, and side panels abut and rest against a peripheral portion 61 of the bottom panel 20. This inter-fitting relationship assures a good mechanical connection between these elements. Also this inter-fitting relationship helps to prevent the intrusion of fluids and insects into the bottom on the deck box. Fasteners, such as screws 62, are employed to secure the bottom panel 20 to the front, back and side panels (FIG. 5). As illustrated in FIG. 6, fasteners 62 are inserted into particular depressions or apertures 64 on the lower side of the bottom panel 20. The bottom panel further includes other depressions or apertures 66 spaced along the lower side of the bottom panel. The bottom panel is formed from plastic or a resin material.

Figure 7:
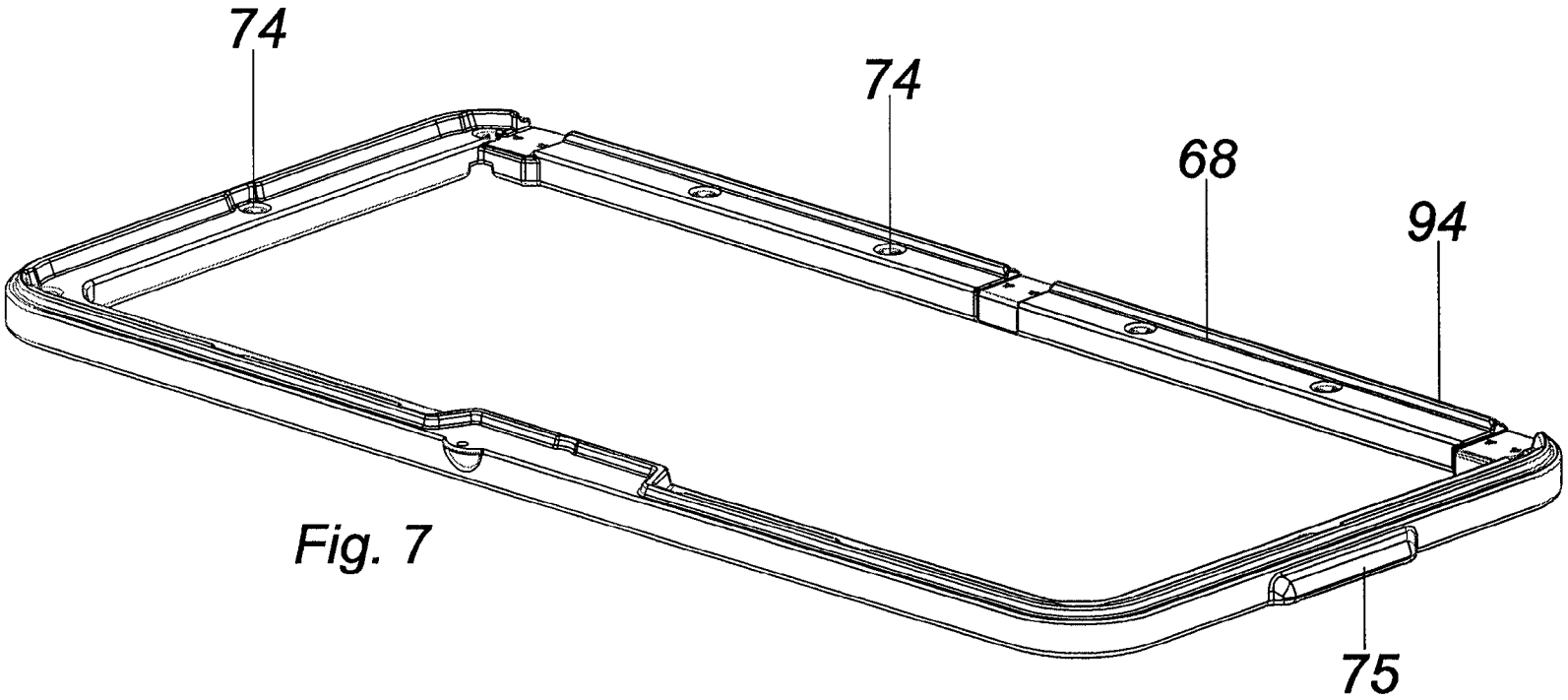
FIG. 7 is a top perspective view of a lid frame member.
Figure 8:
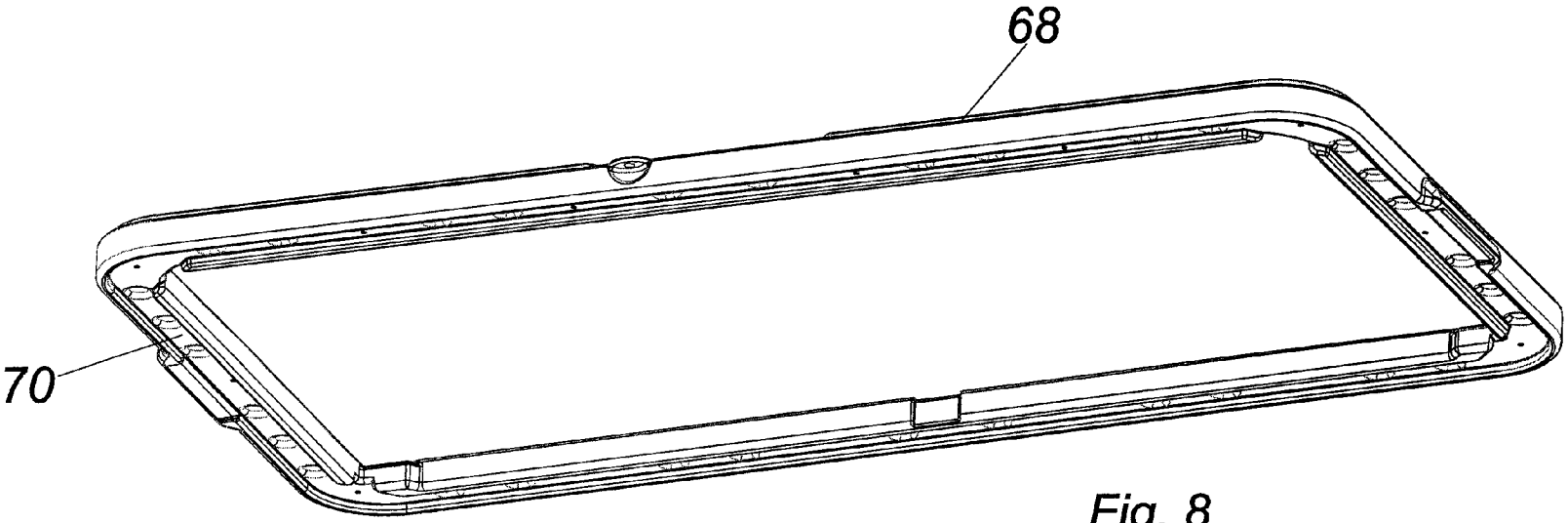
FIG. 8 is a bottom perspective view of a lid frame member.

A frame 68 is secured to the top portions of the front, back, and side panels (FIGS. 5, 9, and 10). The frame 68 includes a track or groove 70 which extends around the lower periphery of the frame, as illustrated in FIGS. 8-10. The top edges of the slats 32 of the front, back, and side panels fit into this groove. Also, the top edges of cross braces 38 and 42 fit into this groove, as illustrated in FIGS. 9 and 10. Fasteners, such as screws 72, secure the frame 68 to the top of the front, back, and side panels. The fasteners 72 pass through depressions or apertures 74 in the frame (FIG. 7). The frame includes handles 75. These handles can be used to lift the deck box. The frame is formed from a plastic or a resin material.

A lid 30 is hingedly secured to the frame and thus the deck box. Left hinge 76, right hinge 78 and center hinge 80 are secured to both the lid 30 and frame 68. A plurality of indents 82, 84, and 86 are provided on the frame 68 in which the hinges 76, 78 and 80 are respectively inserted. These indents provide the correct alignment for the placement of the hinges onto the lid. Fasteners 88 are employed to secure the hinges 76-80 to both the frame 68 and lid 30. Opening and closing retarders 90, such as gas shocks, are secured to the left and right hinges 76 and 78. These retarders 90 assist in the opening of the lid 30. They also prevent lid 30 from being slammed shut. The lid 30 includes a plurality of apertures 81 spaced along a lower side of the lid, (FIGS. 9 and 10). The lid also includes a groove 91 (FIG. 4) which extends around an outer periphery of the lid. The groove interacts with a ridge 94 on the frame. The ridge 94 is formed along an outer periphery on top of the frame (FIG. 7). The ridge 94 and groove 91 mate together to form a seal between the lid and the main portion of the deck box. Lid 30 includes an upstanding lip 92 which extends along the back and sides of the lid. The lid also includes ridges 95 which extend from the front toward the rear of the lid. The lid is formed from plastic or a resin material. A cushion, not shown, can be placed on the lid so that it can be used as a seat.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A deck box comprising:

a right side panel enclosing a right side of said deck box, said right side panel being constructed from a first non-moldable material;

a left side panel enclosing a left side of said deck box, said left side panel being constructed from said first non-moldable material;

a front panel enclosing a front of said deck box, said front panel being constructed from said first non-moldable material;

a back panel enclosing a back of said deck box;

a bottom panel enclosing a bottom of said deck box, said bottom panel being constructed from a moldable resin material, said bottom panel including a groove which extends around an inner periphery of said bottom panel, a lid enclosing a top of said deck box; and a plurality of corner posts, said corner posts being secured to each end of said right side panel, said left side panel, said front panel, and said back panel, said right side and said left side panels being secured between said front and said back panels thereby forming an outer periphery of said deck box;

a frame member, said frame member including a groove extending around a lower periphery thereof said groove constructed and arranged to accept a top portion of said left side, right side, front, and back panels, said frame member including a top surface, said lid pivotably secured to said frame member for movement between an open and a closed position, said lid permitting access into said deck box; and a lower cross brace extending along a bottom portion of each of said right side, left side, front and back panels, wherein a bottom edge of said lower cross brace is spaced from the respective bottom edge of said left side, right side, front, and back panels, and said bottom edge of said lower cross brace is positioned within and cooperates with said groove of said bottom panel to provide an inter-fitting connection between said bottom panel and said left side, right side, front, and back panels.

2. The deck box of claim 1 wherein said right side, left side, front, and back panels are formed of a plurality of slats, each of said slats includes a tongue along one longitudinal edge and a groove along an opposite longitudinal edge, said tongue of one of said slats fits into said groove of an adjacent slat thereby securing said slats together.

3. The deck box of claim 2 including an upper cross brace extending along a top portion of each of said right side, left side, front, and back panels.

4. The deck box of claim 3 wherein a top edge of said upper cross brace and the top ends of said slats are aligned with each other.

5. The deck box of claim 3 including a frame, said frame extending around and enclosing upper ends of said left side, right side, front, and back panels.

6. The deck box of claim 5 wherein said frame includes a track extending around a lower periphery of said frame, an upper edge of said upper cross brace and the upper ends of each of said slats of said left side, right side, front, and back panels are positioned within and cooperate with said track to provide an inter-fitting connection between said frame and said left side, right side, front, and back panels.

7. The deck box of claim 6 including fasteners securing said frame to said left side, right side, front, and back panels.

8. The deck box of claim 5 including hinges, said hinges secure said lid to said frame.

9. The deck box of claim 8 wherein said hinges positioned toward an end portion of said deck box include a gas shock.

10. The deck box of claim 2 wherein each said corner post includes a groove extending along a longitudinal edge of said corner post, each of said slats on each end of said left side, right side, front, and back panels includes a tongue extending along a longitudinal outer edge, wherein said tongues of said slats of said left side, right side, front, and back panels inter-fit into said grooves of said corner posts.

11. The deck box of claim 1 including fasteners securing said bottom panel to said left side, right side, front, and back panels.

12. The deck box of claim 1 wherein said lid includes a lip extending around a portion of a periphery of said lid.

13. The deck box of claim 1 wherein said left side, right side, front, and back panels are formed of wood, said bottom panel and said lid are formed of a plastic or resin material.

* * * * *